US005376148A

United States Patent [19]

Schafflützel

[11] Patent Number: 5,376,148

[45] Date of Patent: Dec. 27, 1994

[54] PROCESS FOR PRINTING SYNTHETIC FIBRE MATERIAL BY TRANSFER PRINTING

[75] Inventor: Paul Schafflützel, Basel, Switzerland

[73] Assignee: Ciba-Geigy Corporation, Ardsley, N.Y.

[21] Appl. No.: 45,454

[22] Filed: Apr. 8, 1993

[30] Foreign Application Priority Data

Apr. 15, 1992 [CH] Switzerland ..... 1246/92-3

[51] Int. Cl.[5] ..... D06P 1/52; C09B 67/00

[52] U.S. Cl. ..... 8/471; 8/555; 8/557; 8/907; 8/908; 8/920; 8/922

[58] Field of Search ..... 8/471, 555, 557, 907, 8/908, 920, 922

[56] References Cited

FOREIGN PATENT DOCUMENTS

| | | |
|---|---|---|
| 100808 | 2/1984 | European Pat. Off. . |
| 161038 | 11/1985 | European Pat. Off. . |
| 190002 | 8/1986 | European Pat. Off. . |
| 1595680 | 4/1970 | Germany . |
| 2434753 | 2/1976 | Germany . |

OTHER PUBLICATIONS

Chem Abst. 93 (8)/73 688k *(1980) *no month available.

Chem Abst. 113 (26)/233 284n *(1989) *no month available.

Derw. Abst. 78-49 155A (Dec. 1977).

Derw. Abst. 90-118759 (Mar. 1990).

Derw. Abst. 76-11385X/07 Af DE 2434753 (Feb. 1976).

Derw. Abst. 68-02773Q/00 Af DE 1595680 (Apr. 1970).

Dere. Abst. AN 75-57771w Feb. 1975.

Chem. Abst. vol. 101, 24942p *(1984) *no month available.

*Primary Examiner*—Paul Lieberman
*Assistant Examiner*—Margaret Einsmann
*Attorney, Agent, or Firm*—George R. Dohmann

[57] ABSTRACT

There is disclosed a process for printing synthetic fibre by transfer printing, which comprises using a printing paste comprising (a) a water-soluble polymer that contains sulfo groups, and one or more than one component selected from the group consisting of (b) a deaerator, (c) an anionic or nonionic dispersant, and (d) a $C_1$-$C_3$alkanol.

Tinctorially strong, patterned prints on a white ground of good levelness, good fastness properties and sharp contours are obtained with the process of this invention. The printing pastes are distinguished by good homogeneity, excellent storage properties and simple handling.

12 Claims, No Drawings

PROCESS FOR PRINTING SYNTHETIC FIBRE MATERIAL BY TRANSFER PRINTING

The present invention relates to a process for printing synthetic fibre material by transfer printing and to the printing paste used for said printing.

The transfer printing process has long been known and is disclosed, inter alia, in DE-OS 2 434 753.This process ordinarily comprises printing sublimable disperse dyes on transfer paper, the so-called support, and transferring the dyes from said support to the textile fabric by applying heat and pressure in a transfer printing machine.

The printing pastes applied to the support must meet exacting requirements with respect to their viscosity, fastness to rubbing, adhesive properties and the like. To satisfy these requirements, the printing pastes used for transfer printing contain at least one thickener and one binder. Known combinations typically comprise sodium alginate as thickener and polyvinyl alcohol as binder. A printing paste comprising these components has, however, an insufficient shelf-life and homogeneity, so that the resultant print is adversely affected.

Synthetic thickeners constitute an alternative to the natural alginates. But these thickeners are sensitive to electrolytes and therefore have only limited suitability for printing with anionic and ionic dye formulations.

The present invention accordingly has for its object to provide a printing paste that contains no alginates and which at the same time is insensitive to electrolytes and homogeneous and has good storage properties. Surprisingly, it has been found that the use of specific water-soluble polymers in printing pastes meet these requirements.

Accordingly, the invention relates to a process for printing synthetic fibre material by transfer printing, which comprises using a printing paste comprising (a) a water-soluble polymer that contains sulfo groups, and one or more than one component selected from the group consisting of (b) a deaerator (c) an anionic or nonionic dispersant, and (d) a $C_1$–$C_3$alkanol.

The printing paste comprising components (a) and (b), (c) and/or (d) likewise constitutes an object of the invention.

The transfer prints obtained with the novel process are tinctoriaily strong and fast to light, washing and rubbing. A further advantage of the novel process is that component (a) acts simultaneously as thickener and binder. The use of a further binder component is thereby made redundant, so that the preparation and handling of the stock thickening or printing paste is substantially simplified.

Suitable water-soluble polymers (a) are typically homopolymer, copolymers or graft polymers which contain ≧20% molar of units of a monomer containing sulfo groups.

Exemplary monomers containing sulfo groups are:
(meth)acrylamidomethanesulfonic acid,
vinylsulfonic acid,
(meth)allylsulfonic acid,
2-acrylamido-2-methylpropanesulfonic acid,
3-(meth)acrylamidopropanesulfonic acid,
3- sulfopropyl(meth)acrylate,
bis(3-sulfopropylitaconate),
4-styrenesulfonic acid, and
3-allyloxy-2-hydroxypropylsulfonic acid.

Preferably the polymer (a) is selected from homopolymers of monomers containing sulfo groups or copolymers which contain more than 50% molar, preferably more than 75% molar, of monomer units containing sulfo groups.

Especially preferred are homo- and copolymers which contain ≧50% molar, most preferably ≧75% molar, of 2-acrylamido-2-methylpropanesulfonic acid units.

The polymer (a) may be in the form of the free acid or of the ammonium salt, alkali metal (Na, K, Li) salt or alkaline earth metal (e.g. Ca) salt. Mixtures of different cations are also possible.

If the polymer (a) is a copolymer, then suitable comonomers free of sulfo groups are typically carboxyl group containing monomers, phosphoric acid group containing monomers or other comonomers.

Suitable comonomers having carboxyl function are typically (meth)acrylic acid, maleic acid, fumaric acid, itaconic acid, mesaconic acid, citraconic acid, vinylacetic acid, vinyloxyacetic acid, vinylpropionic acid, crotonic acid, aconitic acid, allylacetic acid, allyloxyacetic acid, $\alpha\beta$-dimethylacrylic acid, allylmalonic acid, allyloxymalonic acid, methylenemalonic acid, 2-hydroxy(meth)acrylic acid, 2-halo(meth)acrylic acid, $\alpha$-ethylacrylic acid, acrylamidoglycolic acid, glutaconic acid, $\beta$-carboxyethylacrylate, allyloxy-3-hydroxybutanoic acid, and allylsuccinic acid.

Suitable comonomers containing a phosphoric acid group are typically vinylphosphonic acid, (meth)allylphosphonic acid, and acrylamidomethylpropanephosphonic acid.

The following monomers are also suitable comonomers: N-vinylpyrrolidone, N-vinylformamide, N-vinyl-N-methylformamide, N-vinylacetamide, N-vinyl-N-methylacetamide, N-vinyl-N-ethylacetamide, N-vinylimidazole, N-vinyl-N-methylimidazole, N-vinylimidazoline, N-vinyl-2-methylimidazoline, N-vinylcaprolactam, vinyl acetate, vinyl propionate, vinyl butyrate, $C_1$–$C_{22}$alkylvinyl ketone, $C_1$–$C_{22}$alkylvinyl ethers, olefins (ethylene, propylene, isobutene), 1,2-dimethoxyethylene, styrene derivatives, hydroxyethyl/propyl/butyl/(meth)acrylate, N-mono/N-disubstituted $C_1$–$C_{22}$(meth)acrylamide, alkoxy(meth)acrylates, $C_1$–$C_{22}$alkyl(meth)acrylates, (meth)acrolein, (meth)acrylonitrile, (meth)acrylamide, ester/(subst.) amides/nitriles of the toohomers having carboxyl function, $EO_x$-$PO_y$-$ButO_z$ where x,y,z =0–250,dimethyl/-diethylaminoethyl/propyl/butyl (meth)acrylates in the form of the salts or in quaternised form, suitable quaternising agents being typically dimethyl/ethyl sulfate, methyl/ethyl chloride or benzyl chloride.

Homopolymers of alkali metal salts of 2-acrylamido-2-methylpropanesulfonic acid have been found especially suitable as component (a).

The polymers and copolymers used and their preparation are known per se. The water-soluble polymers eligible for use in the practice of this invention are preferably formulated in aqueous solution. Suitable initiators are peroxide compounds that are able to form radicals, typically hydrogen peroxide, di-tert-butyl oxide, benzoyl peroxide, lauryl peroxide or cumene hydroperoxide. The polymerisation can also be initiated with aliphatic azo compounds. In addition, the conventional redox catalyst systems such as hydrogen peroxide/iron(II) sulfate are eminently suitable for initiating the polymerisation.

The polymerisation is normally carded out in the acid to neutral range. The temperature of the polymerisation is usually in the range from 20° to 100° C., preferably from 40° to 80° C. The polymer solutions obtained are conveniently 15 to 30% and have viscosities in the range from e.g. 4000 to 20, 000 cP. The viscosity, which shall preferably be higher than 9000 cP, is a measure of the degree of polymerisation.

Component (b) may be any commercially available deaerator, provided the rheological properties of the novel printing paste are not adversely affected. Owing to their good defoaming properties, suitable deaerators are those of low to no silicone oil content and which contain 0 to c. 10 percent by weight, preferably 2 to 8 percent by weight, of a conventional silicone oil.

Preferred deaerators contain as active ingredient e.g. high-boiling hydrocarbons, hydrogenated naphthalenes, mineral oils, fatty oils or insoluble metal soaps or mixtures thereof, and they may contain the amount of silicone oil specified above. They may, however, also be in the form of aqueous solutions that normally contain a nonionic surfactant, typically an ethylene oxide adduct with an alkyl phenol, in addition to the active ingredients of the indicated kind. Preferred components or active ingredients of the deaerators are higher alcohols with boiling points above c. 100° C., terpentine oils, mineral oils or mixtures thereof. It is preferred to use mixtures of hydrocarbons which normally have a flash point above c. 120° C., preferably of c. 150° to 220° C., and a boiling range from c. to 500° C. under normal conditions.

Particularly interesting deaerators are those containing an octanol as active ingredient, typically 2-ethyl-n-hexanol or a mixture thereof with high-boiling hydrocarbons, and having the indicated content of silicone oils, and which are in the form of aqueous formulations which, in addition to the active ingredients, contain an adduct of ethylene oxide with an alkyl phenol having 6 to 12 carbon atoms in the alkyl moiety as surfactant.

The anionic or nonionic dispersant used as component (c) acts as protective colloid. Its function is to inhibit the unwanted orthokinetic coagulation of the concurrently used dye formulations under the influence of high shear forces. It therefore exerts a stabilising influence on the concurrently used dye formulations. The addition of component (c) to the printing paste is advantageous whenever the disperse dye formulation in the printing paste is present in amounts smaller than 12% by weight of the printing paste. Suitable anionic dispersants are ligninsulfonates, polyphosphates or condensates of aromatic sulfonic acids and formaldehyde. Useful nonionic dispersants are polyadducts of 15 to 100 mol of ethylene oxide or propylene oxide with polyhydric aliphatic $C_2$–$C_6$ alcohols such as ethylene glycol, glycerol or pentaerythritol.

The preferred component (c) is a polyvinyl acetate which has been hydrolysed to polyvinyl alcohol and which has a molecular weight in the range from 12,000 to 30,000, preferably from 15,000 to 25,000, and a degree of hydrolysis of 75 to 85% molar.

If the printing paste contains a $C_1$–$C_3$alkanol as component (d), said alkanol is methanol, ethanol, n- or isopropanol or a mixture of different $C_1$–$C_3$alkanols. It is preferred to use ethanol or mixtures of ethanol/methanol, ethanol/n-propanol or ethanol/isopropanol. If a mixture of two alkanols is used as component (d), the mixture ratio may vary within wide limits.

Preferred printing pastes for the novel process are those wherein component (a) is a homo-or copolymer containing ≧50% molar, preferably ≧75% molar, of 2-acrylamido-2-methylpropanesulfonic acid units, component (b) is a aleaerator which contains an octanol as active ingredient, and, optional component (c) is a polyvinyl acetate which has been hydrolysed to polyvinyl alcohol and which has a molecular weight in the range from 12,000 to 30,000 and a degree of hydrolysis of 70 to 85% molar.

A preferred embodiment of the invention relates to the use of a printing paste comprising 1.5 to 6, preferably 2.5 to 5 and, most preferably, 3.2 to 4.4, percent by weight of component (a),
0.1 to 1.5, preferably 0.1 to 0.8 and, most preferably, 0.2 to 0.6, percent by weight of component (b),
0 to 1, preferably 0.3 to 0.5, percent by weight of component (c), and water to make up 100% by weight.

A further preferred embodiment of the invention relates to the use of a printing paste comprising 0.5 to 2.5, preferably 1 to 2, percent by weight of component (a), 0.1 to 1.5, preferably 0.4 to 1.2, percent by weight of component (b), 1 to 6, preferably 2 to 4, percent by weight of component (c), and water to make up 100% by weight.

Yet a further preferred embodiment of the invention relates to the use of a printing paste comprising 0.5 to 2.5, preferably 1 to 2, percent by weight of component (a),
0 to 1.5, preferably 0.4 to 1.2, percent by weight of component (b),
1 to 6, preferably 2 to 4, percent by weight of component (c),
5 to 45, preferably 20 to 40, percent by weight of component (d), and water to make up 100% by weight.

The novel printing pastes are always free from alginate-containing compounds.

Useful dyes for the novel process are the customary sublimable disperse dyes which are suitable for heat transfer printing and which vapourise in the temperature range from c. 160° to c. 230° C., i.e. dyes whose vapour pressure at e.g. 200° C. is higher than c. $10^{-5}$. These dyes are water-insoluble or sparingly soluble in water and belong to different dye classes typically nitro dyes, aminoketone dyes, ketone-imine dyes, methine dyes, nitrodiphenylamine dyes, quinoline dyes, aminonaphthoquinone dyes, coumarin dyes and, preferably, anthraquinone dyes or azo dyes such as monoazo or disazo dyes. It is also possible to use mixtures of different disperse dyes.

It is advantageous not to use the dye by itself (cut or uncut), but to use an aqueous formulation that contains the water-insoluble or sparingly soluble dye (or dye mixture).

Owing to the resistance to electrolytes of component (a), the eligible dyes may be formulated to anionic and also nonionic dye formulations.

The amount of dye formulation in the printing paste will depend on the desired tinctorial strength and is usually from 0.1 to 40 percent by weight, preferably from 0.1 to 30 percent by weight, of the formulation, based on the weight of the printing paste.

A preferred embodiment of this invention relates to the use of a printing paste comprising 2.5 to 5% by weight of a homopolymer of alkali metal salts of 2-acrylamido-2-methylpropanesulfonic acid as component (a), 0.1 to 0.8% by weight of a deaerator that contains an octanol as component (b), 0 to 1% by weight of a polyvinyl acetate which has been partially hydrolysed to polyvinyl alcohol and which has a molecular weight in the range from 12 000 to 30 000 and a degree of hydrolysis of 70 to 85% molar as component (c), 0.1 to 30% by weight of a formulation of a sublimable disperse dye, and water to make up 100% by weight.

The printing paste is formulated in conventional manner by mixing components (a) and (b), (c) and/or (d) with the desired dye formulation, and adding the requisite amount of water at the conclusion, so that the viscosity is adjusted to a value suitable for rotogravure printing, typically from 40 to 500 mPa.s, preferably from 100 to 300 mPa.s and, most preferably, from 180 to 300 mPa.s. Printing pastes for rotary screen printing desirably have a higher viscosity, typically from 2000 to 5000 mPa.s.

For printing, the printing paste is applied to the whole surface of the support, preferably patterned, conveniently using printing machines of standard make, typically rotary screen, flexographic printing and, most preferably, rotogravure printing machines.

The support used for transfer printing is desirably a flexible, preferably dimensionally stable ribbon, a strip or a foil with a smooth surface. The support must be heat-resistant and inert, i.e. have no affinity for the different components of the printing paste. It may be made of different materials, typically metal such as aluminium or steel foil, plastic, paper or a textile fabric, which materials may be coated with a film of vinyl resin, ethyl cellulose or polyurethane resin. For cost reasons, the preferred support is paper.

After applying the printing paste, the printed support is dried at c. 80° to 140° C., preferably at 100° to 120° C., for about 5 to 20 seconds. The actual transfer printing is carried out on a press batchwise or on a conventional heat printing machine continuously in the temperature range from 120° to 230° C., preferably from 190° to 220° C., over a contact time of about 5 to 90 seconds, preferably of 20 to 60 seconds, under pressure, whereupon the dye transfers from the support to the fibre materials.

Upon completion of the heat and pressure treatment, the printed fibre material is separated from the support. As a rule no aftertreatment is required, i.e. usually neither a steam treatment to fix the dye or a washing-off to improve the fastness properties. The material to be printed comprises typically coated materials, synthetic or semi-synthetic sheets, for example polyester sheets or, preferably, textile materials, preferably planar structures such as nonwovens, felts, especially carpets, knitgoods and, more particularly woven fabrics. Suitable textile materials are those made from semi-synthetic and, preferably, man-made fibres or mixtures thereof. Semi-synthetic fibres are mainly regenerated cellulosic fibres, typically triacetate, and the man-made fibres are mainly polyacrylonitrile, polyamide and, preferably, polyester fibres. Blends of triacetate and polyamide or polyester/cotton or polyester/wool are also suitable for the novel process.

Tinctorially strong, patterned prints on a white ground of good levelness, good fastness properties and sharp contours are obtained with the process of this invention.

The printing pastes used in the practice of this invention are novel and constitute a further object of the invention. They are distinguished by good homogeneity, excellent shelf-life and simple handling.

Unless otherwise indicated, the percentages in the following Examples are by weight.

EXAMPLE 1

A paper support is partially printed on a rotogravure machine with a printing paste of the following composition:

100 g/kg of a dispersed commercial formulation of low electrolyte content of a disperse dye of formula

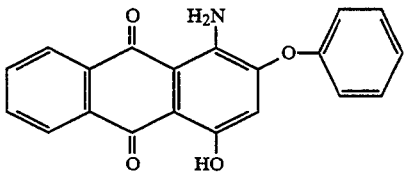

(I)

150 g/kg of a 25% aqueous solution of the homopolymer of 2-acrylamido-2-methyl-propanesulfonic acid 4 g/kg of a deaerator based on 2-ethyl-n-hexanol;

10 g/kg of a 30% aqueous solution of a polyvinyl acetate which has been hydrolysed to polyvinyl alcohol and which has a molecular weight in the range from 12,000 to 30,000 and a degree of hydrolysis of 70 to 85% molar; and water to make up 1 kg.

The printing paste has a pH of 7.5. The viscosity is 215 mPa.s, measured in a RVT Brookfield viscosimeter, spindle 2 (20 rpm) at 25° C.

The printed support is dried for 8 seconds at 100° C. It has good storage properties and is rubfast. Then the printed side of the support is contacted with a synthetic fibre material, e.g. a polyester woven fabric with a weight per unit area of 100 g/m$^2$, and then support and fabric are pressed together for 30 seconds at 210° C. on an ironing press, whereupon the dye transfers from the support to the fabric.

A tinctorially strong, red patterned print on a white ground of good levelness, good fastness properties and with sharp contours is obtained on the polyester fabric.

EXAMPLES 2–10

The procedure of Example 1 is repeated, but replacing the formulation of the dye of formula (I) with the equivalent amount of a formulation of one of the dyes listed in the following Table:

| Example | Dye | Shade |
|---|---|---|
| 2 | 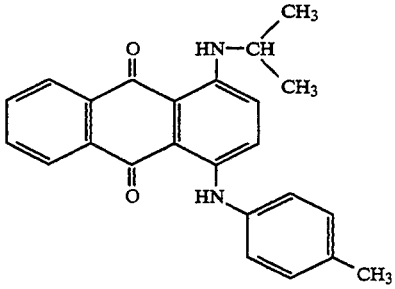 | turquoise |
| 3 | 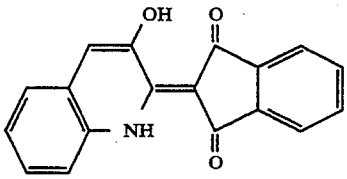 | yellow |
| 4 | 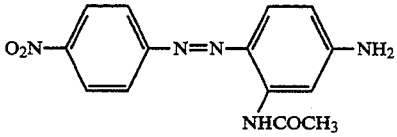 | orange |
| 5 | 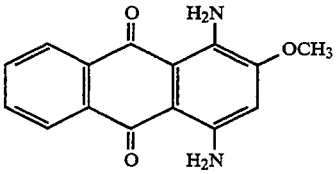 | red |
| 6 | 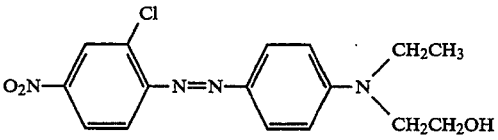 | bordeaux |
| 7 | 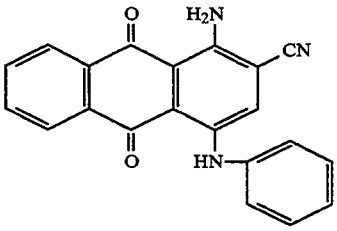 | blue |
| 8 | 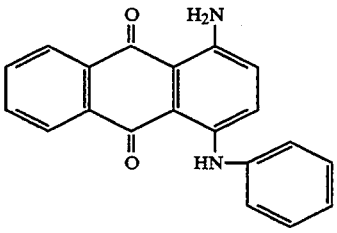 | blue |

-continued

| Example | Dye | Shade |
|---|---|---|
| 9 | 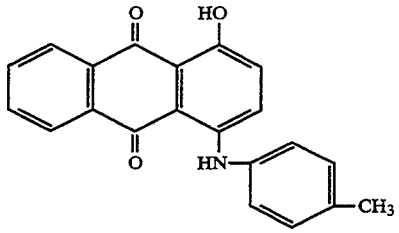 | blue |
| 10 | mixture comprising:<br>dye according to Example 2<br>dye according to Example 3<br>dye according to Example 4<br>dye according to Example 8<br>dye according to Example 9 | black |

A patterned print on a white ground of good levelness, good fastness properties and with sharp contours is obtained in each Example on polyester fabric which, after printing, has a soft handle.

EXAMPLE 11

The procedure of Example 1 is repeated, but replacing the printing paste used therein with a printing paste of the following composition:

150 g/kg of the disperse dye formulation of Example 1;

70 g/kg of a 25% aqueous solution of the homopolymer of 2-acrylamido-2-methylpropanesulfonic acid;

80 g/kg of a 30% aqueous solution of a polyvinyl acetate which has been partially hydrolysed to polyvinyl alcohol and which has a molecular weight in the range from 12,000 to 30,000 and a degree of hydrolysis of 70 to 85% molar;, 6 g/kg of a deaerator based on 2-ethyl-n-hexanol;

694 g/kg of demineralised water.

The printing paste has a pH of 7.8. The viscosity is 130 mPa.s, measured in a RVT Brookfield viscosimeter, spindle 2 (20 rpm) at 25° C.

EXAMPLE 12

The procedure of Example 11 is repeated, using a printing paste that contains 10 g/kg instead of 6 g/kg of deaerator based on 2-ethyl-n-hexanol, and 690 g/kg instead of 694 g/kg of demineralised water, to give a printing paste of comparably good properties.

EXAMPLE 13

The procedure of Example 1 is repeated, but replacing the printing paste used therein with a printing paste of the following composition:

150 g/kg of the disperse dye formulation of Example 1;

70 g/kg of a 25% aqueous solution of the homopolymer of 2-acrylamido-2-methylpropanesulfonic acid;

80 g/kg of a 30% aqueous solution of a polyvinyl acetate which has been partially hydrolysed to polyvinyl alcohol and which has a molecular weight in the range from 12,000 to 30,000 and a degree of hydrolysis of 70 to 85% molar, 400 g/kg of 94% ethanol;

300 g/kg of demineralised water.

The printing paste has i pH of 7.9. The viscosity is 130 mPa.s, measured in a RVT Brookfield viscosimeter, spindle 2 (20 rpm) at 25° C.

EXAMPLE 14

The procedure of Example 13 is repeated, using a printing paste that additionally contains 5 g/kg of a deaerator based on 2-ethyl-n-hexanol, and 295 g/kg instead of 300 g/kg of demineralised water, to give a printing paste of comparably good properties.

EXAMPLE 15

The procedure of Example 1 is repeated, but replacing the printing paste used therein with a printing paste of the following composition:

150 g/kg of the disperse dye formulation of Example 1;

150 g/kg of a 25% aqueous solution of the homopolymer of 2-acrylamido-2-methylpropanesulfonic acid;

5 g/kg of a deaerator based on 2-ethyl-n-hexanol;

400 g/kg of 94% ethanol;

295 g/kg of demineralised water.

The viscosity is 220 mPa.s, measured in a RVT Brookfield viscosimeter, spindle 2 (20 rpm) at 25° C.

EXAMPLE 16

The procedure of Example 15 is repeated, using a printing paste that contains 10 g/kg of a 30% aqueous solution of a polyvinyl acetate which has been partially hydrolysed to polyvinyl alcohol and which has a molecular weight in the range from 12,000 to 30,000 and a degree of hydrolysis of 70 to 85% molar, and 290 g/kg of demineralised water instead of 5 g/kg of a aleaerator based on 2-ethyl-n-hexanol, and 295 g/kg of demineralised water, to give a printing paste of comparably good properties.

EXAMPLE 17

The procedure of Example 15 is repeated, replacing 400 g/kg of ethanol with a mixture of 200 g/kg of ethanol and 200 g/kg of isopropanol or n-propanol, to give a printing paste of comparably good properties.

EXAMPLE 18

The procedure of Example 1 is repeated, but replacing the printing paste used therein with a printing paste of the following composition:

150 g/kg of the disperse dye formulation of Example 1;

150 g/kg of a 25% aqueous solution of the homopolymer of 2-acrylamido-2-methylpropanesulfonic acid;

5 g/kg of a deaerator based on 2-ethyl-n-hexanol;

695 g/kg of demineralised water.

A printing paste of comparably good properties is obtained.

What is claimed is:

1. A process for printing a synthetic fibre material by transfer printing, which process comprises applying a printing paste to a support, drying the printed support and subsequently contacting the printed support with the synthetic fiber material; wherein the printing paste is free of alginate containing compounds and comprises a sublimable disperse dye, (a) a water-soluble polymer that contains sulfo groups, and one or more than one component selected from the group consisting of (b) a deaerator, (c) an anionic or nonionic dispersant, and (d) a $C_1$–$C_3$alkanol.

2. A process according to claim 1, wherein component (a) is a homopolymer, copolymer or graft polymer which contains ≧20% molar of units of a monomer containing sulfo groups selected from the group consisting of (meth)acrylamidomethanesulfonic acid, vinylsulfonic acid, (meth)allylsulfonic acid, 2-acrylamido-2-methylpropanesulfonic acid, 3-(meth)acrylamidopropanesulfonic acid, 3- sulfopropyl(meth)acrylate, bis(3-sulfopropylitaconate), 4-styrenesulfonic acid, and 3-allyloxy-2-hydroxypropylsulfonic acid.

3. A process according to claim 1, wherein component (a) is a homo- and copolymer which contains ≧50% molar of 2-acrylamido-2-methylpropanesulfonic acid units.

4. A process according to claim 1, wherein component (a) is a homopolymer of 2-acrylamido-2-methylpropanesulfonic acid in the form of an alkali metal salt or alkaline earth metal salt.

5. A process according to claim 1, wherein component (b) contains a higher alcohol having a boiling point above c. 100° C., a terpentine oil, a mineral oil or a mixture thereof.

6. A process according to claim 1, wherein component (b) is an octanol or a mixture thereof with a mixture of high-boiling hydrocarbons which contains silicone oil.

7. A process according to claim 1, wherein component (c) is a polyvinyl acetate which has been hydrolysed to polyvinyl alcohol and which has a molecular weight in the range from 12,000 to 30,000 and a degree of hydrolysis of 75 to 85% molar.

8. A process according to claim 1, wherein the printing paste comprises as component (a) a homo- or copolymer containing ≧50% molar of 2-acrylamido-2-methylpropanesulfonic acid units, as component (b) a deaerator which contains an octanol as active ingredient, and optional as component (c) a polyvinyl acetate which has been hydrolysed to polyvinyl alcohol and which has a molecular weight in the range from 12,000 to 30,000 and a degree of hydrolysis of 70 to 85% molar.

9. A process according to claim 1, wherein the printing paste comprises 2.5 to 5 percent by weight of component (a), 0.1 to 0.8 percent by weight of component (b), 0 to 1 percent weight of component (c), and water to make up 100% by weight.

10. A process according to claim 1, wherein the printing paste comprises 0.5 to 2.5 percent by weight of component (a), 0 to 1.5 percent by weight of component (b), 1 to 6 percent by weight of component (c), and water to make up 100% by weight.

11. A process according to claim 1, which comprises the use of a printing paste comprising 0.5 to 2.5 percent by weight of component (a), 0 to 1.5 percent by weight of component (b), 1 to 6 percent by weight of component (c), 5 to 45 percent by weight of component (d), and water to make up 100% by weight.

12. A process according to claim 1, which comprises the use of a printing paste comprising 2.5 to 5% by weight of a homopolymer of alkali metal salts of 2-acrylamido-2-methylpropanesulfonic acid as component (a), 0.1 to 0.8% by weight of a deaerator that contains an octanol as component (b), 0 to 1% by weight of a polyvinyl acetate which has been partially hydrolysed to polyvinyl alcohol and which has a molecular weight in the range from 12,000 to 30,000 and a degree of hydrolysis of 70 to 85% molar as component (c), 0.1 to 30% by weight of a formulation of a sublimable disperse dye, and water to make up 100% by weight.

* * * * *